US006270020B1

(12) United States Patent
Thompson et al.

(10) Patent No.: US 6,270,020 B1
(45) Date of Patent: Aug. 7, 2001

(54) ROADWAY DEICING SYSTEM

(75) Inventors: Jeffrey M. Thompson, Roseville; David L. June, Sutter; Barry D. Stephens, Roseville, all of CA (US)

(73) Assignee: Energy Absorption Systems, Inc., Chicago, IL (US)

( * ) Notice: Subject to any disclaimer, the term of this patent is extended or adjusted under 35 U.S.C. 154(b) by 0 days.

(21) Appl. No.: 09/473,639

(22) Filed: Dec. 28, 1999

(51) Int. Cl.[7] ..... B05B 7/30; A01G 27/00

(52) U.S. Cl. ..... 239/67; 239/69; 239/70; 239/172; 239/302; 239/337; 239/379; 239/346

(58) Field of Search ..... 239/172, 302, 239/303, 337, 346, 351, 352, 373, 379, 67, 200, 201, 202, 69, 70

(56) References Cited

U.S. PATENT DOCUMENTS

| | | | | |
|---|---|---|---|---|
| 1,526,908 | * | 2/1925 | Gates | 239/352 X |
| 1,860,136 | * | 5/1932 | Bunch | 239/373 X |
| 3,637,048 | * | 1/1972 | Mount | 184/6.1 |
| 3,921,907 | * | 11/1975 | Anderson | 239/172 |
| 4,161,280 | | 7/1979 | Kasinskas . | |
| 4,222,044 | | 9/1980 | Boschung . | |
| 4,230,045 | | 10/1980 | Fearon . | |
| 4,651,927 | * | 3/1987 | Vestergaard | 239/172 X |
| 4,898,330 | * | 2/1990 | Betchan | 239/337 X |
| 5,028,017 | | 7/1991 | Simmons et al. . | |
| 5,282,590 | | 2/1994 | Zwick . | |
| 5,447,272 | | 9/1995 | Ask . | |
| 5,603,452 | * | 2/1997 | Hester | 239/302 X |
| 5,746,396 | | 5/1998 | Thorton-Trump . | |
| 5,988,535 | * | 11/1999 | Kime | 239/172 X |
| 6,042,023 | | 3/2000 | Ask . | |
| 6,082,638 | | 7/2000 | Ask et al. . | |
| 6,102,306 | | 8/2000 | Ask et al. . | |

* cited by examiner

*Primary Examiner*—David A. Scherbel
*Assistant Examiner*—Robin O. Evans
(74) *Attorney, Agent, or Firm*—Brinks Hofer Gilson & Lione

(57) ABSTRACT

A roadway deicing system uses a pressurized gas stored in a high pressure tank to dispense a solid or liquid deicer onto a roadway. An electrically powered controller responds to control inputs to control valves, such as solenoid valves, to cause the deicer to be dispensed at appropriate times. Since electrical power is not used for propelling the deicer onto the roadway, conventional storage batteries can provide long service life for the system between maintenance intervals.

6 Claims, 9 Drawing Sheets

ROADWAY DEICING SYSTEM

BACKGROUND

The present invention relates to systems for spreading deicer on roadways, and in particular to systems of this type that are well suited for use in remote locations.

Freezing water on roadways causes driving hazards, and it has been suggested in the past to provide roadside systems for dispensing a deicer such as a brine solution or rock salt onto the roadway when icing conditions are present. See the systems described in U.S. Pat. Nos. 4,222,044; 5,447,272; and 5,282,590.

The deicing systems identified above all include an electrically powered pump or spreader for propelling the deicer onto the roadway. This approach is not well suited for use in remote locations, where it may not be convenient or economical to connect the deicing system to the power grid. The present invention is directed to an improved roadway deicing system that overcomes this disadvantage of the prior art.

SUMMARY

By way of introduction, the roadway deicing system described in detail below includes a deicer storage container as well as a pressurized gas storage container. A dispenser is coupled both to the deicer storage container and to the pressurized gas storage container, and this dispenser is powered by pressurized gas to propel deicer from the deicer storage container onto a roadway.

Because the dispenser is powered by pressurized gas, the deicing system described below requires relatively low electrical power to operate. For this reason, it is well suited to be powered by conventional storage batteries.

The foregoing paragraphs have been provided merely by way of introduction, and they are not intended to limit the scope of the following claims.

DETAILED DESCRIPTION OF THE PREFERRED EMBODIMENTS

Figure 1:
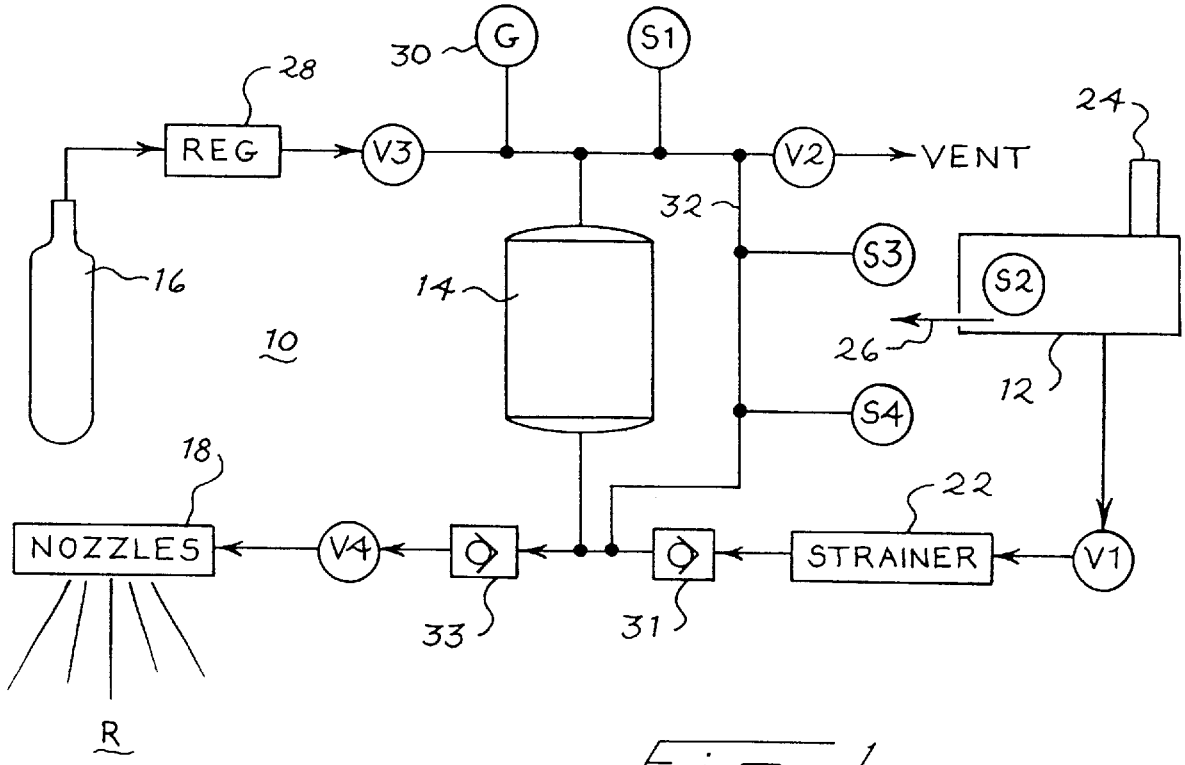
FIG. 1 is a block diagram of a roadway deicing system that incorporates a preferred embodiment of this invention.

Turning now to the drawings, FIG. 1 is a block diagram of a first roadway deicing system 10. The system 10 includes a storage tank 12, a pressure tank 14, and a nitrogen tank 16.

The storage tank 12 is adapted to store a quantity of a suitable deicer. In this example, the deicer is a liquid such as a suitable brine, and the storage tank 12 has a capacity suitable for extended unsupervised operation, such as 300 gallons for example. The deicer is introduced into the storage tank 12 via a fill port 24, and if necessary can be drained from the storage tank 12 via a drain port 26.

The pressure tank 14 in this example is a five gallon pressure vessel capable of withstanding internal pressures up to about 175 psi. The pressure tank 14 is connected to the storage tank 12 by a strainer 22 and a solenoid valve V1.

The nitrogen tank 16 is a conventional high-pressure gas bottle having for example 150 to 250 cubic feet of high pressure gas such as nitrogen. The nitrogen tank 16 is connected to the pressure tank 14 via a pressure regulator 28 and a solenoid valve V3. The pressure regulator 28 preferably provides a regulated output pressure of 200 psi for example. A gauge 30 allows the pressure of the pressure tank 14 to be monitored. Another solenoid valve V2 can be opened to vent the pressure tank 14. A conduit 32 that is positioned along side the pressure tank 14 includes two liquid level switches S3, S4 that provide output signals indicating when the liquid in the pressure tank 14 exceeds the level of the respective switches.

The pressure tank 14 is connected to one or more dispensing nozzles 18 via a fourth solenoid valve V4. The nozzles 18 are positioned to spray or otherwise dispense liquid deicer under pressure onto a roadway R. Check valves 31, 33 prevent deicer from flowing from the pressure tank 14 to the storage tank 12 and from the nozzle 18 to the pressure tank 14.

The system 10 relies on gravity to move deicer from the storage tank 12 to the pressure tank 14, and for this reason the pressure tank 14 is disposed at a lower level than the storage tank 12. In this example, the pressure tank 14 has a volume of about 2 gallons between the higher level indicated by the switch S3 and the lower level indicated by the switch S4. A pressure switch S1 is normally open. The pressure switch S1 closes when the pressure of the pressure tank 14 reaches 150 psi, and it opens when the pressure of the pressure tank 14 falls to 100 psi.

Figure 2:
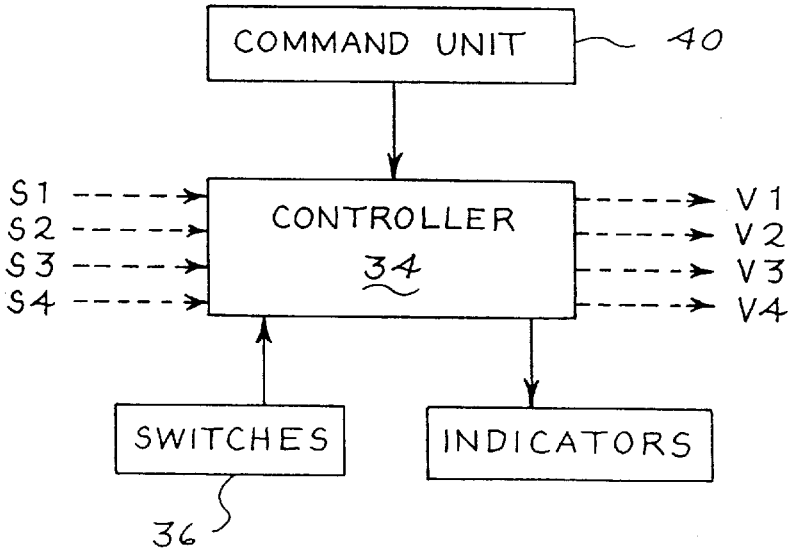
FIG. 2 is a block diagram of a controller included in the system of FIG. 1.

The switches S1–S4 provide inputs to a controller 34, as shown in FIG. 2. The controller also receives control inputs from control panel switches 36 and from a command unit 40. The controller processes these input signals to provide output control signals to valves V1–V4.

The command unit 40 can generate dispense commands in any suitable way. For example, dispense commands can be generated by a timer to cause deicer to be dispensed at a selected time of day. Alternately, dispense commands can be generated manually or in response to radio or telephone signals. As yet another alternative, dispense commands can be generated automatically when temperature and humidity conditions indicate a danger of icing conditions.

Figure 3:
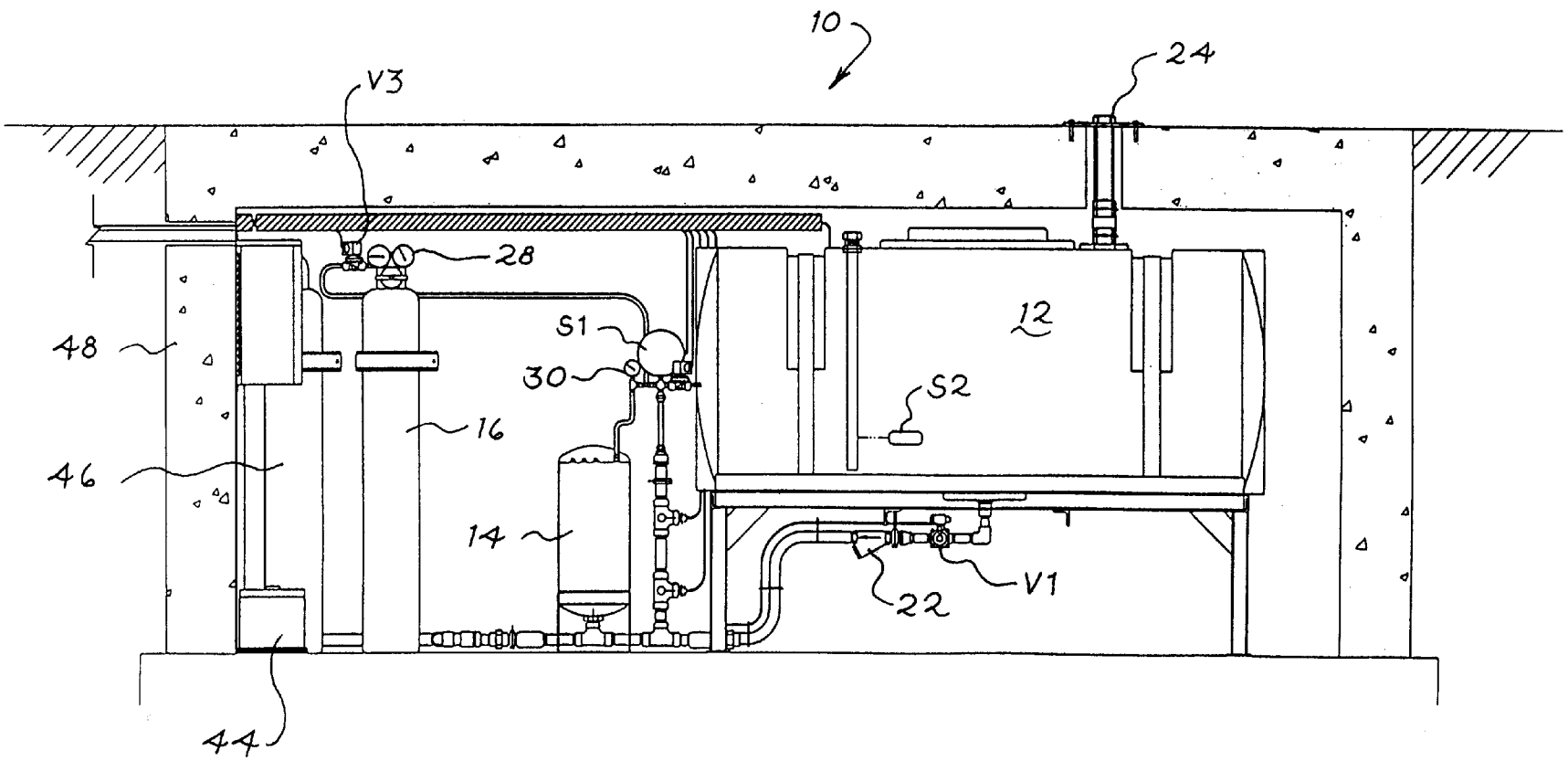
FIGS. 3 and 4 are front and end views, respectively, of portions of the system of FIG. 1.
Figure 4:
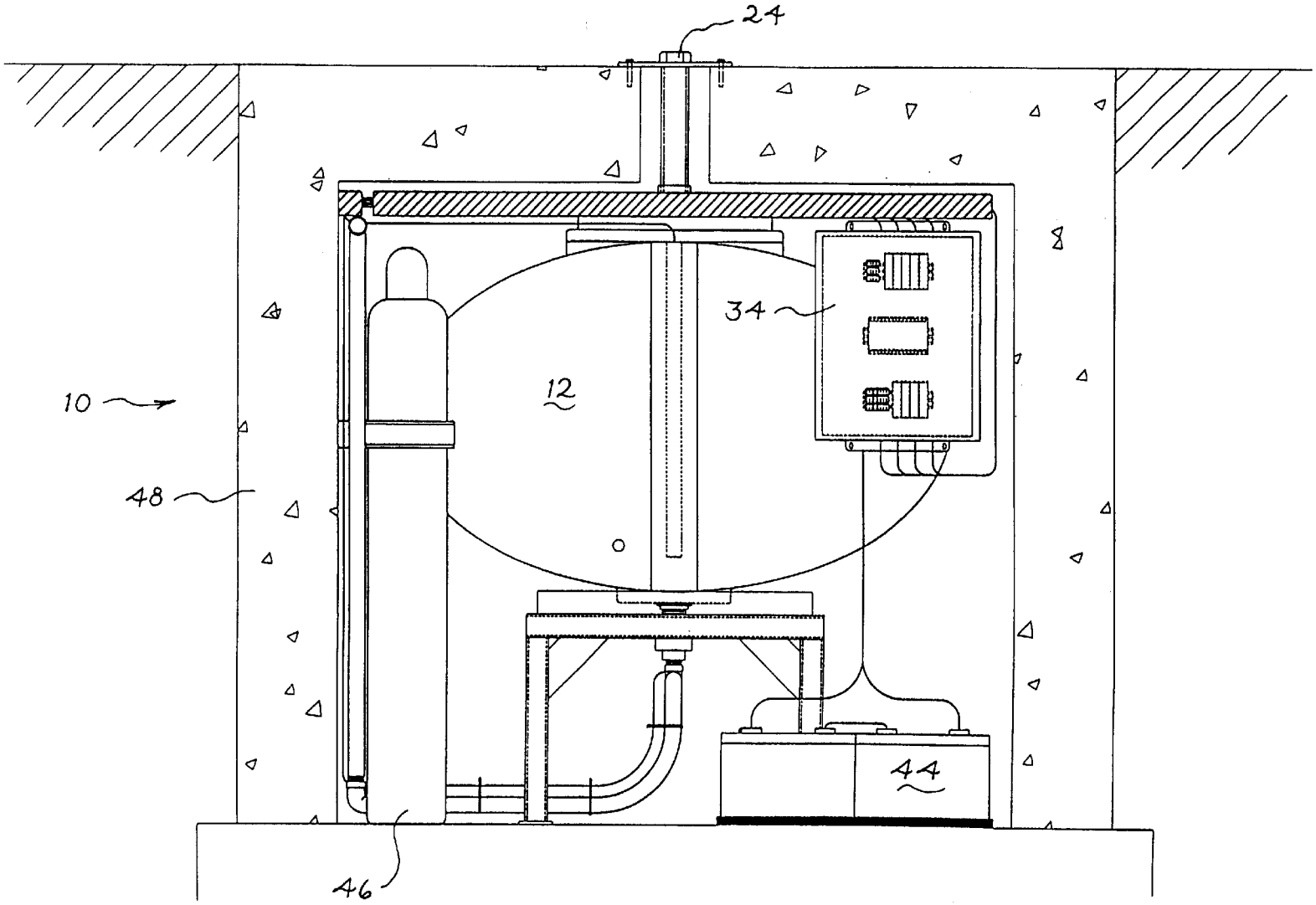
Figure 5:
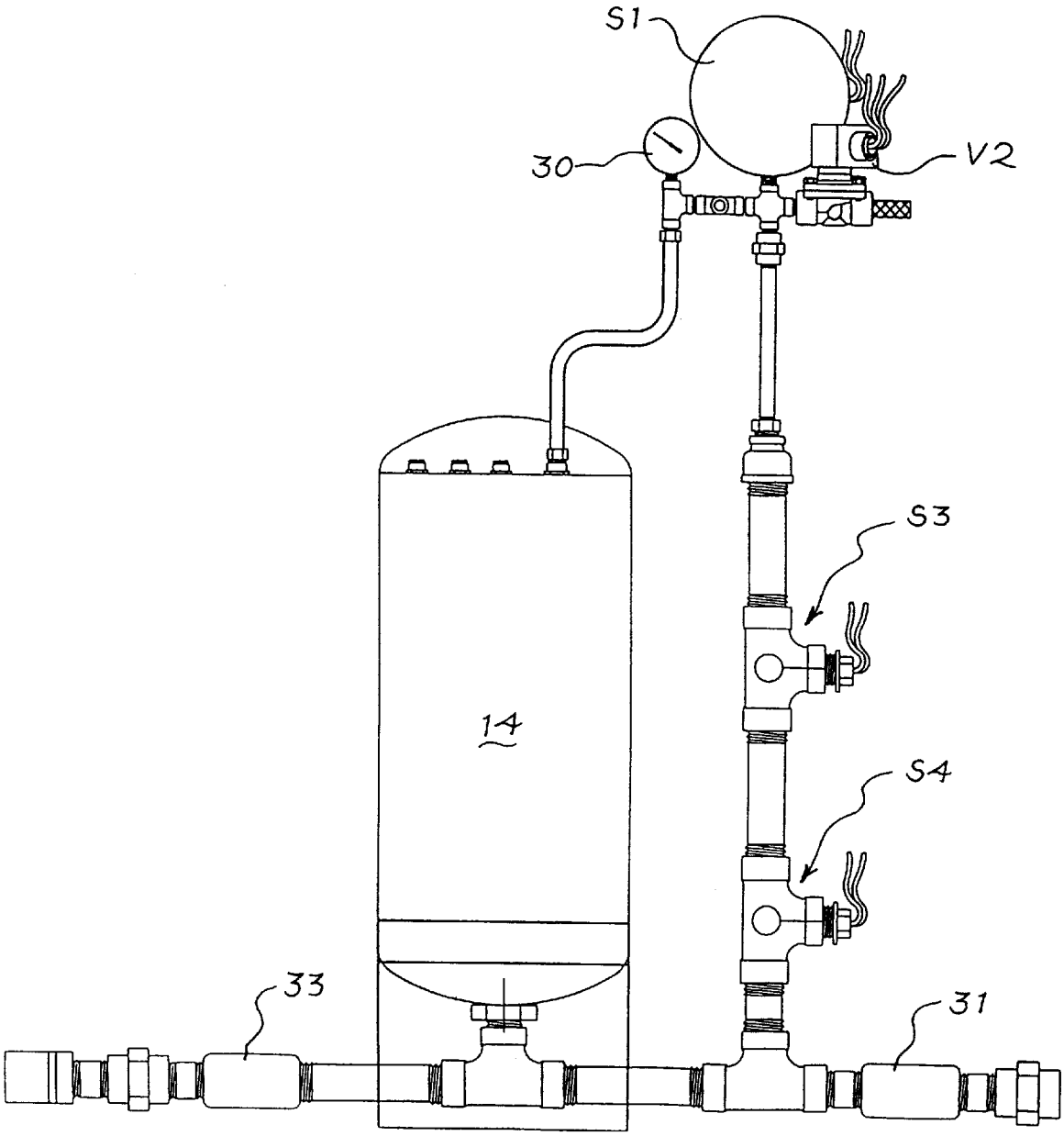
FIG. 5 is an enlarged front view of a portion of FIG. 3.

FIGS. 3 and 4 provide front and end views, respectively, of the system 10, showing one preferred layout. The controller 34 and the valves V1–V4 are operated with power from electrical batteries 44. For example, two 12-volt DC deep cycle batteries can be used. A spare nitrogen tank 46 can be provided. As shown in FIGS. 3 and 4, major components of the system 10 can be protected within a vault 48, and the fill port 24 can extend above ground level. FIG. 5 shows an enlarged view of the pressure tank assembly, showing preferred relative positions of the illustrated components.

Figure 6:
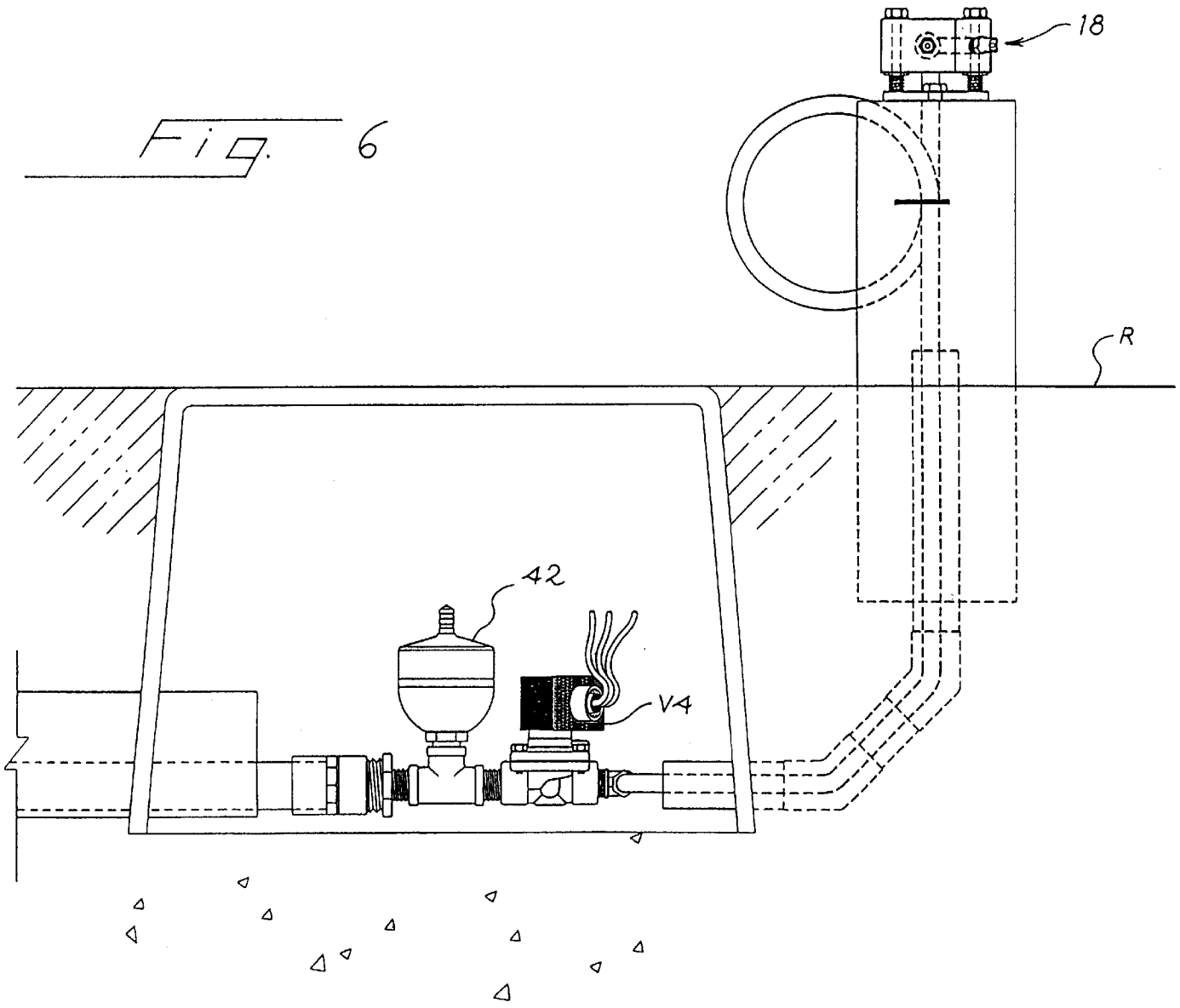
FIGS. 6 and 7 are side and end views, respectively, of additional portions of the system of FIG. 1.
Figure 7:
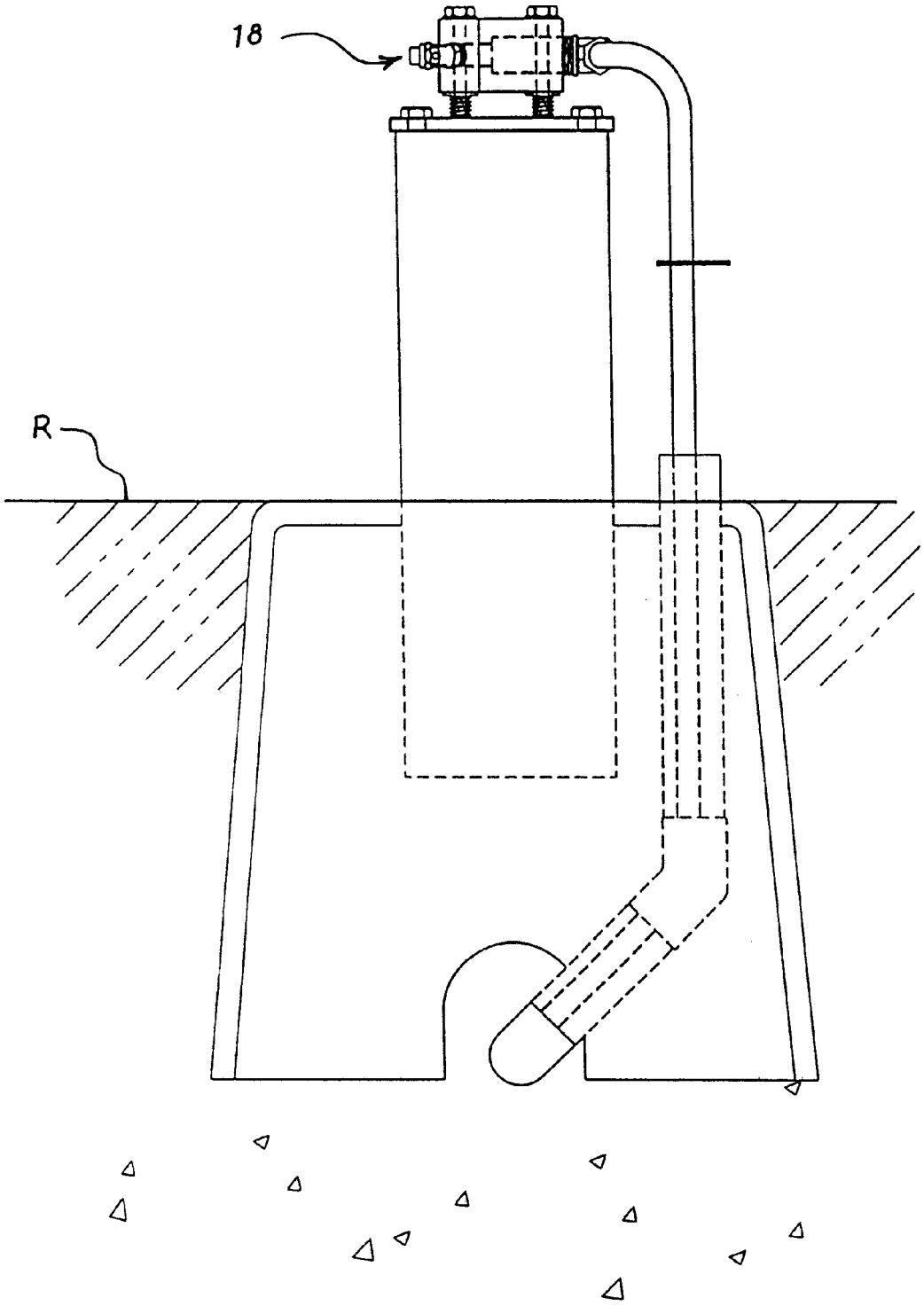

FIGS. 6 and 7 show side and end views, respectively, of one preferred installation for the nozzle 18. Note that the nozzle 18 includes two separate dispensing orifices positioned to spray or stream deicer onto a roadway R. If desired, a conventional water hammer arrester 42 can be provided near the solenoid valve V4. The reference numerals of FIGS. 1 and 2 have been used in FIGS. 3 through 7 to designate the same components.

Figure 8:
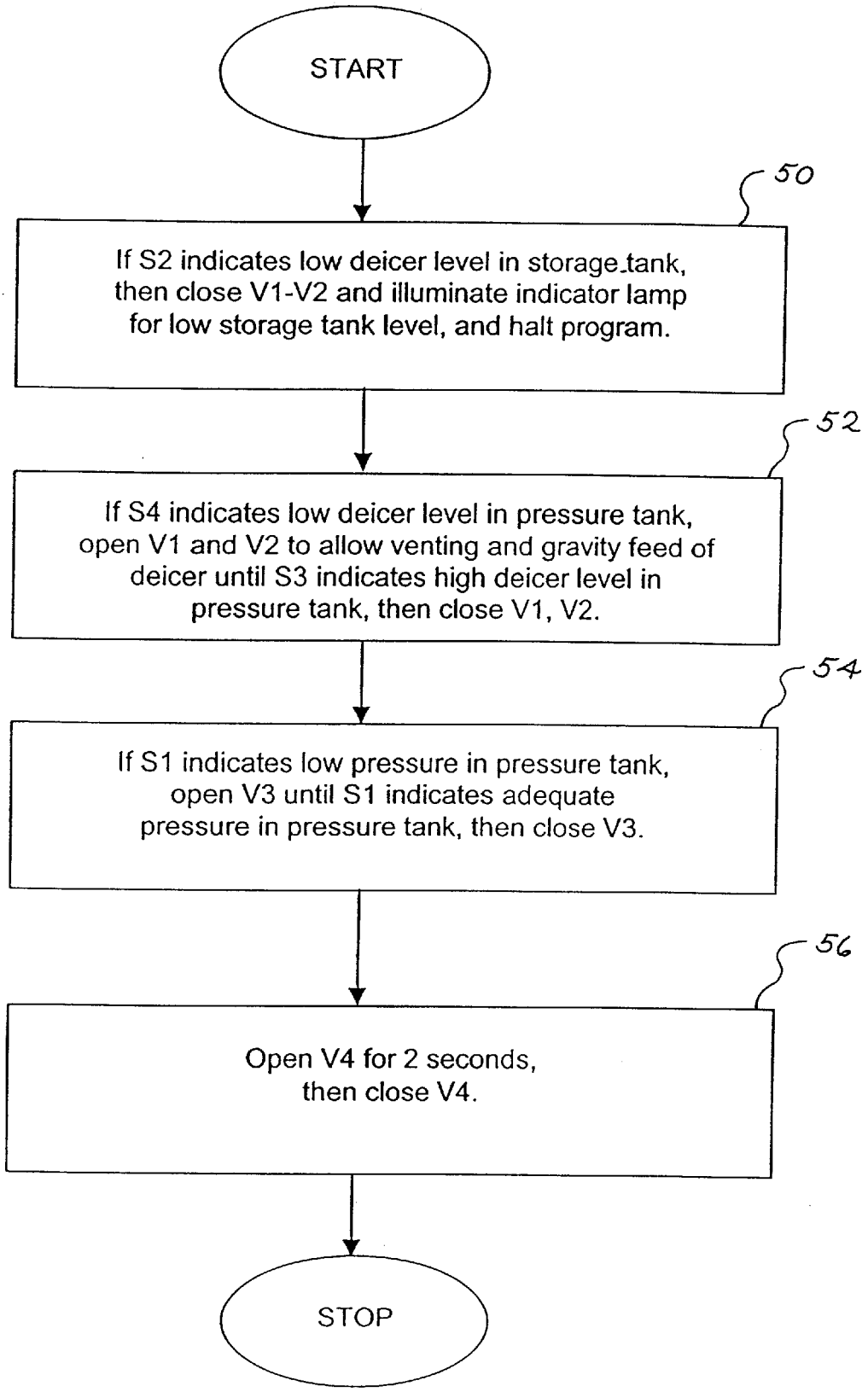
FIG. 8 is a flowchart of a method performed by the system of FIG. 1.

The operation of the controller 34 will now be explained in conjunction with the flowchart of FIG. 8. In this example, the method of FIG. 8 is performed every time a dispense command is received.

In this example, the controller 34 monitors the switches S1–S4, as well as the dispense command, and operates the valves V1–V4 to achieve the desired deicing function. To conserve power, the switches S1–S4 are left unpowered until a dispense command is received. As shown at block 50, the controller 34 checks the switch S2. If the switch S2 is open, indicating a low deicer level in the storage tank 12, the controller closes valves V1–V2 and illuminates an indicator lamp on the control panel. No further deicing is allowed until the storage tank is refilled.

As shown at block 52, the controller checks the switch S4 to insure that there is adequate deicer in the pressure tank 14. If the switch S4 indicates a low deicer level in the pressure tank 14, the controller 34 closes valves V3 and V4 and opens valve V1 and V2 to allow venting and gravity feed of deicer until the switch S3 indicates that the deicer in the pressure tank 14 has reached the upper level. The controller then closes valves V1 and V2. The valve V2 insures that the pressure tank 14 is properly vented so that it can reliably fill under the force of gravity. In this way, the controller insures that the deicer level in the pressure tank 14 is maintained between the upper and lower levels indicated by the level switches S3, S4.

As shown at block 54, the controller 34 then checks the pressure switch S1. If the pressure switch S1 is open, indicating a low pressure condition in the pressure tank 14, the controller opens valve V3 until the pressure switch S1 closes, indicating adequate pressure in the pressure tank. At this point, the controller closes valve V3. In this way, the pressure of the pressure tank 14 is maintained between 100 and 150 psi. This enables the pressure tank to function as an accumulator to dispense deicer under pressure on command.

As shown at block 56, the controller then responds to the dispense command by opening valve V4 for a specified time, such as 2 seconds in one example. Then the controller closes the valve V4. In this example, each time a dispense command is received, the controller opens and closes the valve V4 to dispense about one-half gallon of deicer through the nozzle 18. The pressure tank 14 is sized such that the pressure in the tank falls by about 50 psi after four dispensing cycles. Thus, the controller re-pressurizes the pressure tank 14 via the process of block 52 and refills the pressure tank 14 via the process of block 54 after approximately four dispensing commands.

Figure 9:
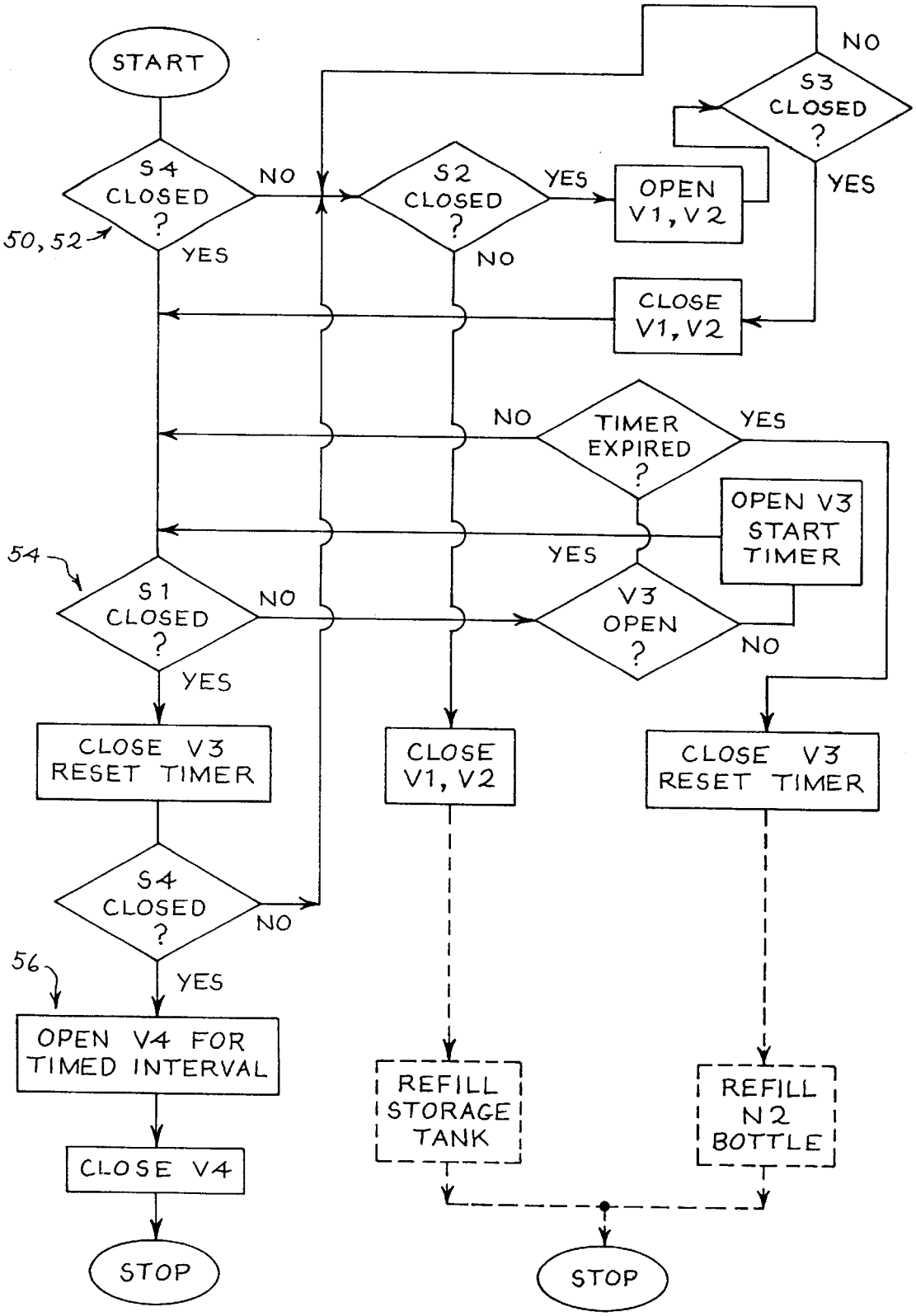
FIG. 9 is a more detailed flow chart of the method of FIG. 8.

Further details of the preferred method of FIG. 8 are provided in FIG. 9. Appendix A provides a listing for a preferred program for implementing the method of FIG. 9. This listing is intended by way of example. Suitable control functions can be implemented in many different ways, using any suitable hardware and software.

By way of example, the components listed in Table 1 have been found suitable for use in the preferred embodiment described above.

TABLE 1

| | |
|---|---|
| Valves | |
| V1 | Parker Gold Ring #12F23C2148A3F4C80 |
| V2, V3 | Parker Gold Ring #04F25C2122C3F4C80 |
| V4 | Parker Gold Ring #08F22C2140A3F4C80 |
| Switches | |
| S1 | Mercoid # DAW 33-153-8 |
| S2 | Omega #LV 612-P |
| S3, S4 | W.E. Anderson Division, Dwyer Instruments #L10-B-3-B |
| Controller 34 | Automation Direct # F1-130-DD-D |
| Panel 36 | Automation Direct #OP-420 |
| Nozzles 18 | Spraying Systems VeeJet #H1/4U-0040<br>Spraying Systems VeeJet #H1/4U-1570 |
| Regulator 28 | Harris # 25-200C-580 |

Figure 10:
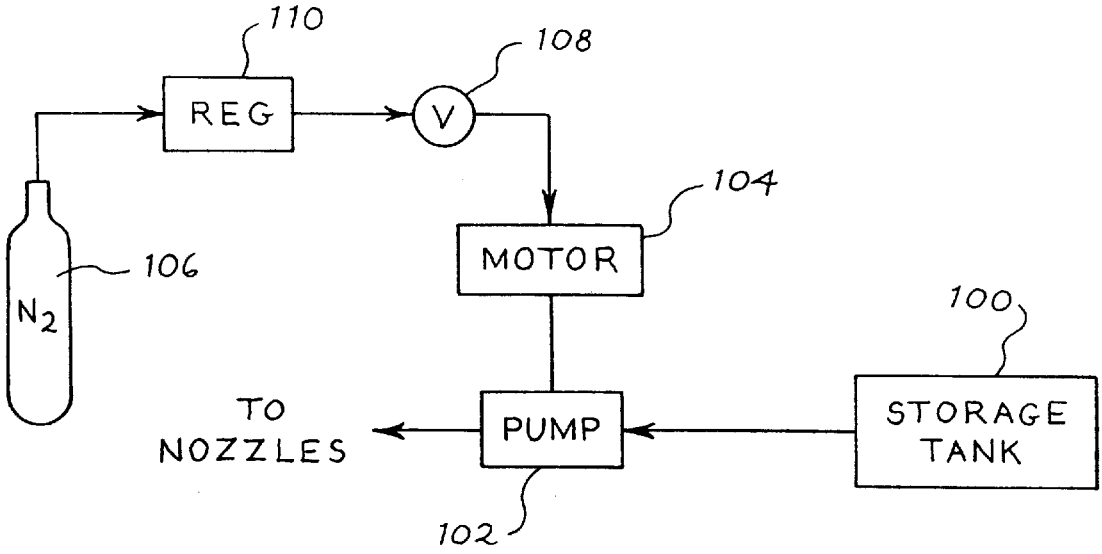
FIGS. 10 and 11 are block diagrams of second and third preferred embodiments, respectively, of the roadway deicing system of this invention.

FIG. 10 relates to a second preferred embodiment of this invention. This embodiment uses liquid deicer stored in a storage tank 100. Deicer from the storage tank 100 is pumped to a nozzle for deicing a roadway by a pump 102. The pump 102 is powered by a pneumatic motor 104 that is driven by pressurized gas contained in a gas bottle 106. Pressurized gas from the bottle 106 passes via a pressure regulator 110 and a solenoid valve 108 to the motor 104. When a controller (not shown) commands that deicer be dispensed, the controller opens the valve 108 to cause the motor 104 to drive the pump 102.

Figure 11:
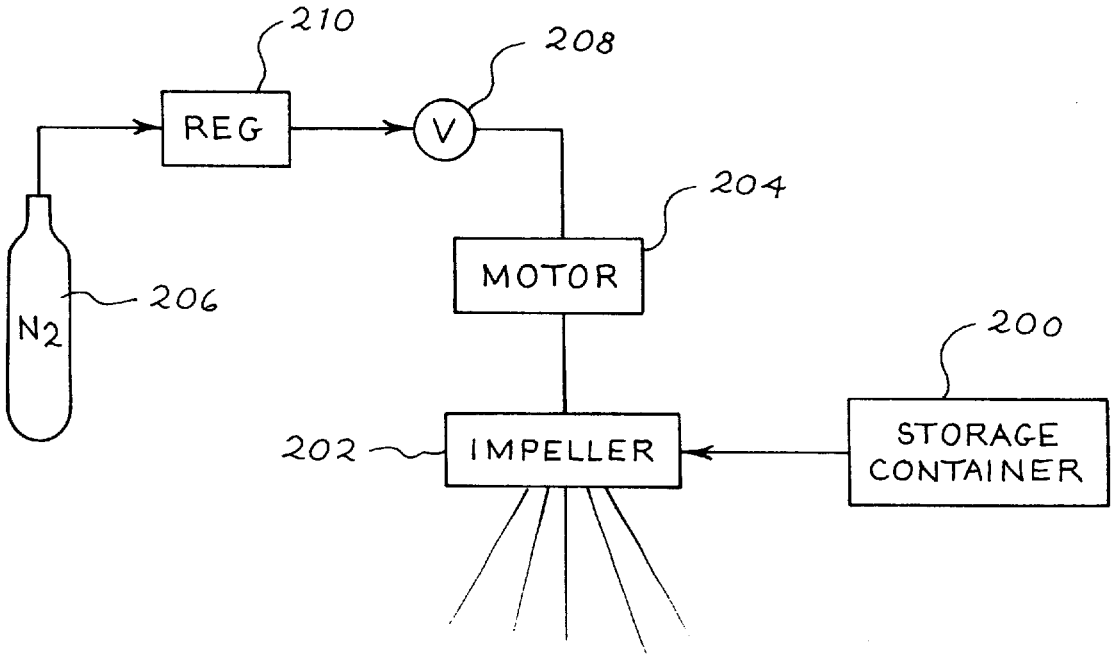

FIG. 11 shows a third preferred embodiment of this invention adapted for use with a solid deicer such as rock salt. In this case, the deicer stored in a storage container 200 is conducted to a dispenser such as an impeller 202. The impeller 202 is rotated by an air motor 204, and the air motor 204 is powered by pressurized gas contained in a bottle 206. When a controller (not shown) commands that deicer be dispensed, pressurized gas from the bottle 206 is passed via a pressure regulator 210 and a solenoid valve 208 to the motor 204. The impeller 202 can be of any suitable design, such as the rotating vane impellers conventionally used on salt trucks.

All of the embodiments described above provide the substantial advantage that deicer is dispensed using pressurized gas stored in a high pressure bottle as the source of energy for propelling the deicer onto the roadway. The electrical load is limited to the electrical power used to operate the controller, the switches and the valves. For this reason, relatively small capacity batteries can be used to power the system over an extended time period, such as 60 days in one example. In a suitable location, the electrical storage batteries can be recharged via a solar cell charging system (not shown).

Of course, it should be understood that many changes and modifications can be made to the preferred embodiment described above. For example, in other embodiments the pressure tank can be eliminated and the storage tank can be pressurized with gas from the storage bottle. Of course, any suitable pressurized gas can be used, and this invention is not limited to use with pressurized nitrogen. Similarly, any suitable technology, including analog circuits, programmable digital computers and ladder-logic controllers, can be used to implement the control functions described above. Also, the widest range of dispensers, pumps, controllers, valves and switches can be adapted for use with the present invention.

The foregoing description has included specific parameters by way of example only. Sizes, flow rates, volumes, pressures and times can all be modified as appropriate for a particular application.

The term "dispenser" is used here in its broad sense to encompass the widest range of gas-powered systems for propelling deicer onto a roadway. The pressure tank assembly of FIG. 1, the pump and motor of FIG. 10, the impeller and motor of FIG. 11, and the pressurizing system for the deicer storage tank described above are all examples of dispensers.

The term "roadway" is intended broadly to encompass roads, bridges and sidewalks.

The term "deicer" includes both liquid and solid deicing materials; and the term "solid" includes granular solids. The term "deicing system" refers broadly to a system that dispenses deicer, whether before or after ice formation.

An element is said to be powered by pressurized gas when a majority of the energy used to operate the element is provided by pressurized gas, even though other energy sources, such as electrical voltages, may also be used, e.g. for control functions.

The foregoing detailed description has discussed only a few of the many forms that this invention can take. For this reason, this detailed description is intended by way of illustration, not limitation. It is only the following claims, including all equivalents, that are intended to define the scope of this invention.

What is claimed is:

1. A roadway deicing system comprising:

a deicer storage container containing a liquid deicer;

a pressurized gas storage container;

a dispenser coupled to the deicer storage container and the pressurized gas storage container, said dispenser powered by pressurized gas from the pressurized gas storage container to propel deicer from the deicer storage container onto a roadway;

said dispenser comprising a nozzle mounted and oriented to direct deicer from the storage container onto the roadway;

a controller operative in response to a command signal to cause the dispenser to propel deicer from the deicer storage container onto the roadway for a brief time; and a command signal generator operative to generate the command signal in response to at least one of the following: a timer, a radio signal, a telephone signal, and temperature and humidity conditions that indicate a danger of icing conditions.

2. The invention of claim 1 wherein the deicer storage container and the pressurized gas storage container are enclosed in a stationarily mounted enclosure.

3. The invention of claim 1 wherein the dispenser comprises a pump comprising a first inlet coupled to the deicer storage container and an outlet, and a motor coupled to the pressurized gas storage container.

4. The invention of claim 1 wherein the dispenser comprises a pressure tank comprising a first inlet coupled to the deicer storage container, an outlet, and a second inlet coupled to the pressurized gas storage container.

5. The invention of claim 1 further comprising at least one battery coupled to power the controller.

6. A roadway deicing system comprising:

a deicer storage container containing a liquid deicer;

a pressurized gas storage container;

a dispenser nozzle mounted and oriented to direct deicer from the storage container onto a roadway;

a pressure tank comprising a pressure inlet coupled with the pressurized gas storage container, a deicer inlet coupled with the deicer storage container, and an outlet coupled with the dispenser nozzle;

a first valve disposed between the pressure tank and the deicer storage container;

a second valve disposed between the pressure tank and the pressurized gas storage container;

a third valve disposed between the pressure tank and the dispenser nozzle;

a controller coupled with the first, second, and third valves, said controller operative to control the valves to introduce the liquid deicer from the deicer storage container into the pressure tank, to pressurize the pressure tank with gas from the pressurized gas storage container, and to dispense the liquid deicer from the pressure tank via the dispenser nozzle;

a plurality of electrically-powered actuators operative to control the first, second, and third valves, and at least one battery coupled to power the controller and the electrically-powered actuators.

* * * * *